US008079119B1

(12) United States Patent
Ferko, III

(10) Patent No.: US 8,079,119 B1
(45) Date of Patent: Dec. 20, 2011

(54) DISPOSABLE CASKET AND BLANK FOR FORMING A DISPOSABLE CASKET

(76) Inventor: Joseph G. Ferko, III, Pasadena, MD (US)

( * ) Notice: Subject to any disclaimer, the term of this patent is extended or adjusted under 35 U.S.C. 154(b) by 280 days.

(21) Appl. No.: 12/473,520

(22) Filed: May 28, 2009

(51) Int. Cl.
*A61G 17/00* (2006.01)

(52) U.S. Cl. ..... 27/4; 229/155

(58) Field of Classification Search ..... 27/4, 2, 27/14, 17; 220/6; 229/126, 155, 165, 186
See application file for complete search history.

(56) References Cited

U.S. PATENT DOCUMENTS 4,156,956 A 6/1979 Partridge et al.
4,170,054 A 10/1979 Ruffner et al.
5,035,032 A * 7/1991 Nutting ..... 27/4
5,586,679 A 12/1996 Thomas
5,770,291 A 6/1998 Tambussi
5,915,680 A 6/1999 Umemura et al.
5,985,399 A 11/1999 Tambussi
6,138,334 A 10/2000 Tambussi
6,145,175 A 11/2000 Enneking et al.
6,154,937 A 12/2000 Enneking et al.
6,238,327 B1 5/2001 Tambussi
6,557,221 B2 5/2003 Cox et al.
6,571,440 B1 6/2003 Faulkner et al.
6,615,464 B2 9/2003 Tambussi
6,684,467 B1 2/2004 Walker
7,003,855 B2 2/2006 Lew
2007/0084028 A1* 4/2007 Cox et al. ..... 27/4

* cited by examiner

*Primary Examiner* — William L. Miller
(74) *Attorney, Agent, or Firm* — Roylance, Abrams, Berdo & Goodman, L.L.P.

(57) ABSTRACT

A disposable casket is made from a one piece unitary blank of a foldable sheet material. The blank is folded to form the disposable casket having a bottom wall, opposite side walls and opposite end walls. Each side wall has a top panel that folds inwardly where the outer edges overlap and interlock with each other. Each end wall has a side flap that is superimposed on a respective side wall. A top end panel is connected to each end wall by a fold line which folds over the respective end of the top panels and interlocks with the top panels to retain the top panels and top end panels in a closed position.

20 Claims, 6 Drawing Sheets

DISPOSABLE CASKET AND BLANK FOR FORMING A DISPOSABLE CASKET

FIELD OF THE INVENTION

The present invention is directed to a blank made of cardboard or fiberboard that can be folded into a disposable casket. The invention is particularly directed to a one piece disposable casket made from the cardboard blank which can be used to transport a body.

BACKGROUND OF THE INVENTION

Caskets for burial and cremation have traditionally been made of wood and constructed as a preassembled rigid structure. Caskets or containers intended for use for cremation have been made of various inexpensive materials such as cardboard, hardboard or plywood. The caskets are generally formed from at least two sections which form a body portion and lid or cap. These caskets are generally rather large and can be difficult to store and ship.

Caskets for cremation have been made from inexpensive materials which can be assembled at the time of use. These caskets generally are provided disassembled which can be shipped in a more compact manner. Some of these caskets are collapsible and can be assembled quickly and easily.

One example of a casket is disclosed in U.S. Pat. No. 6,238,327 to Tambussi which includes a member having a plurality of sections which are assembled together. The various sections are folded along score lines and attached by an adhesive.

A cremation container is disclosed in U.S. Pat. No. 6,571,440 to Faulkner et al. The container is foldable into a compact configuration for shipping and can be erected when needed. The container includes a bottom, a pair of side walls pivoted relative to the bottom and end walls pivoted to the bottom. An angle member connects the adjacent edges of the side and end walls.

A modular cardboard casket is disclosed in U.S. Pat. No. 6,145,175 to Enneking et al. The casket includes an inner box having a bottom, two opposed sides and two opposite ends. The outer part has an outer side with a finish different form the finish of the inner box.

U.S. Pat. No. 4,156,956 to Partridge et al. discloses a foldable cardboard casket formed from a blank that is scored and cut to form bottom walls with upturned side walls, end walls and inwardly directed flaps. A top wall is formed with downwardly extending side walls and end walls with inwardly directed flaps.

Other examples of foldable caskets are disclosed in U.S. Pat. No. 5,586,679 to Thomas, U.S. Pat. No. 4,170,054 to Ruffner et al., U.S. Pat. No. 5,770,291 to Tambussi, and U.S. Pat. No. 5,915,680 to Umemura et al.

While the prior caskets have been suitable for their intended use, there is a continuing need in the industry for improved casket designs and constructions.

SUMMARY OF THE INVENTION

The present invention is directed to a one piece disposable casket made from a cardboard blank where the blank is folded along a plurality of fold lines to form the casket. The invention is also directed to the blank for forming the casket where the blank includes a series of panels and fold lines connecting the panels together. The blank is a one piece member that can be folded to form an enclosed casket. The blank is cut to the desired shape and formed with score lines or fold lines. The blank is formed from cardboard or fiberboard and lies flat such that a plurality of the blanks can be stacked and packaged together for easy shipping and handling. The cardboard blank is made from a suitable material that is waterproof and sufficiently strong to support the weight of a body.

One aspect of the invention is to provide a foldable blank for forming a casket where the blank is substantially flat and can be easily folded and erected to form a casket.

Another aspect of the invention is to form a casket from a blank formed from an inexpensive material where the casket is disposable after use.

Another aspect of the invention is to provide an inexpensive temporary casket for transporting a body from one location to another.

Another aspect of the invention is to provide an inexpensive collapsible casket which can be used to transport a body and where the casket can be placed within a permanent casket.

These and other aspects of the invention can be basically attained by providing a foldable blank for forming a disposable casket where the blank comprises a substantially rectangular bottom panel having first and second parallel sides and first and second parallel ends. A first side wall panel is coupled to the first side of the bottom panel by a fold line and where the first side wall panel has a first top panel coupled thereto by a fold line. A second side wall panel is coupled to the second side of the bottom panel by a fold line and the second side wall panel has a second top panel coupled thereto by a fold line. A first end wall panel is coupled to the first end of the bottom panel by a fold line where the first end wall panel has a first top end panel coupled thereto by a fold line. The first end wall panel has a coupling portion for coupling with the first and second top panels when in the folded position. A second end wall panel is coupled to the second end of the bottom panel by a fold line where the second end wall panel has a second top end panel coupled thereto by a fold line. The second top end panel has a coupling portion for coupling with the first and second top panels when in the folded position.

The various aspects of the invention are also attained by providing a disposable casket formed from a one piece folded blank made of cardboard or fiberboard where the casket comprises a bottom wall, a first upstanding side wall and a second upstanding side wall. A first upstanding end wall and a second upstanding end wall are coupled to the bottom wall by fold lines where each of the end walls have two side flaps coupled to side edges of the end walls by fold lines and coupled to a respective side wall. A first top wall having a first edge is coupled to the first side wall by a fold line. A second top wall having a first edge is coupled to the second side wall by a fold line. The first and second top walls have a width to at least partially overlap with each other in a closed position. A first top panel is coupled to the first end wall and a second top panel is coupled to the second end wall where the first top panel and the second top panel overlie and are coupled to the first and second top walls in the closed position.

The various aspects of the invention are further attained by providing a disposable casket formed from a one piece unitary cardboard or fiberboard blank where the casket comprises a planar bottom wall having a substantially rectangular configuration with a first side edge, a second side edge, a first end and a second end. A first side wall having a bottom edge is coupled to the first side edge of the bottom wall by a fold line and extends substantially perpendicular to the bottom wall. The second side wall having a first bottom edge is coupled to the second side edge of the bottom wall by a fold line and extending substantially perpendicular to the bottom wall. A first end wall having a first bottom edge is coupled to the first end of the bottom wall by a fold line and extends perpendicular to the bottom wall. The first end wall has a first side edge with a first side flap coupled thereto by a fold line and is superimposed on the first side wall. The first end wall has a second side edge with a second side flap coupled thereto by a fold line and is superimposed on the second side wall. The second end wall having a first bottom edge is coupled to the second end of the bottom wall by a fold line and extends perpendicular to the bottom wall. The second end wall has a first side edge with a first side flap coupled thereto by a fold line and is superimposed on the first side wall. The second end wall has a second side edge with a second side flap coupled thereto by a fold line and is superimposed on the second side wall. A first top panel is coupled to the top edge of the first side wall and is folded inwardly with respect to the casket. A second top panel is coupled to the top edge of the second side wall and is folded inwardly with respect to the casket. The first and second top panels have a width to overlap each other to close the casket to define a top wall where the first and second top panels include interlocking members to interlock with one another in the closed position.

These and other aspects of the invention will become apparent from the following detailed description of the invention which taken in conjunction with the annexed drawings discloses one embodiment of the invention.

BRIEF DESCRIPTION OF THE DRAWINGS

Referring to the drawings which form part of this original disclosure, in which.

DETAILED DESCRIPTION OF THE INVENTION

The present invention is directed to a blank made of cardboard or fiberboard that can be folded into a disposable casket. The blank is cut from a suitable sheet material and can be stored flat and stacked during shipping. The invention is also directed to a one piece disposable casket made from the cardboard blank which can be used to transport a body. The disposable casket of the invention is particularly suitable for use where a large number of caskets are required such as, for example, a natural disaster. The blanks for forming the caskets are stacked and laid flat for easy shipping and handling and can be folded quickly to construct the disposable casket.

Figure 1:
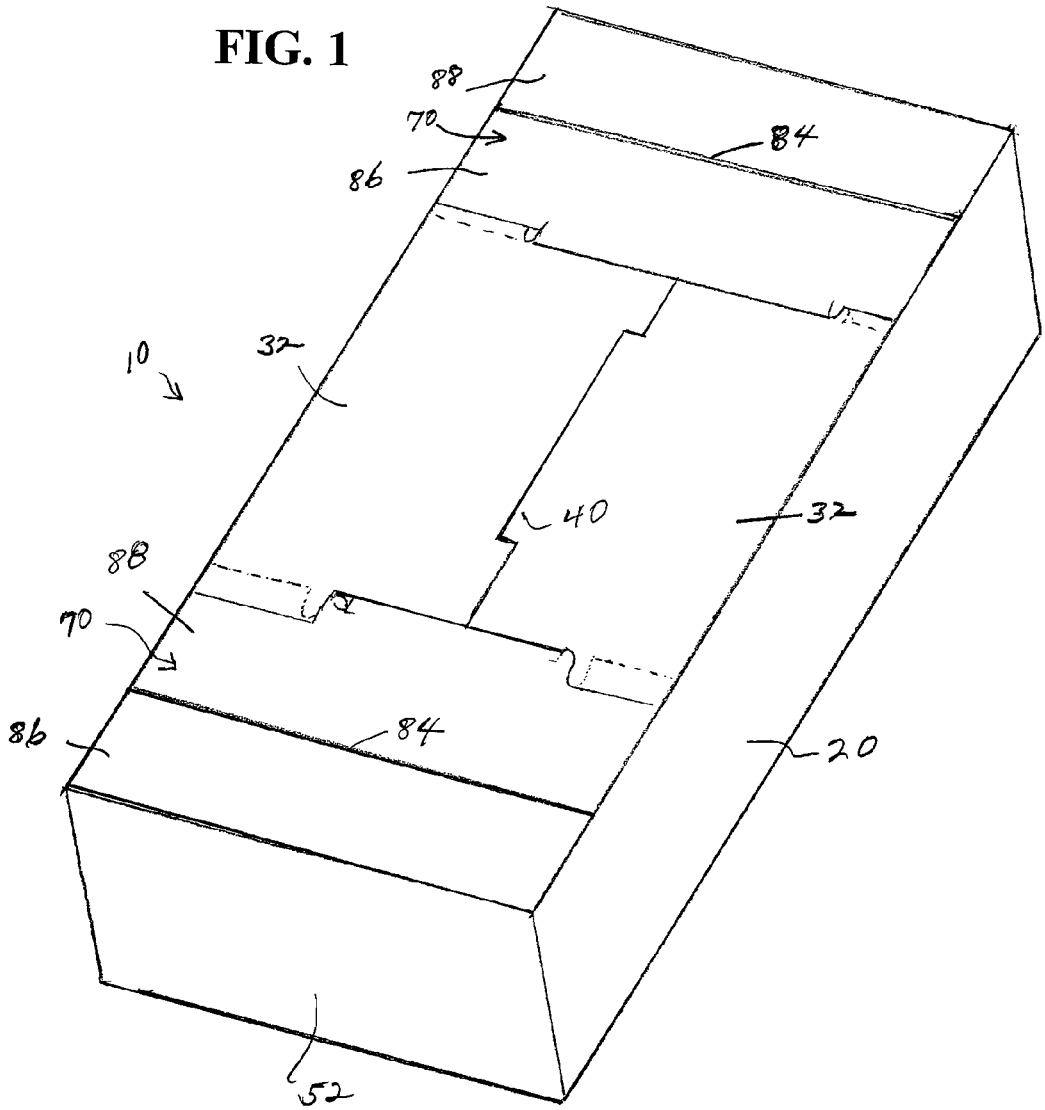
FIG. 1 is a perspective view of the assembled casket in one embodiment of the invention.

Referring to the drawings, the disposable casket 10 of the invention as shown in the assembled condition of FIG. 1 has a substantially rectangular shape with a dimension suitable for containing a body. In one embodiment, the casket 10 has a width of about 24 inches, a length of about 135 inches, and a height of about 12 inches, although the dimensions can be varied as desired.

Casket 10 is generally made from a cardboard or a fiberboard blank with a waterproof coating. In one embodiment, casket 10 is made from corrugated cardboard having a sufficient thickness and strength to support the weight of a body. In other embodiments, casket 10 can be made from a blank made from a plastic material or other suitable material that can be folded to construct the casket. The blank can be made from laminated materials such as multiple cardboard layers bonded together by an adhesive.

Figure 2:
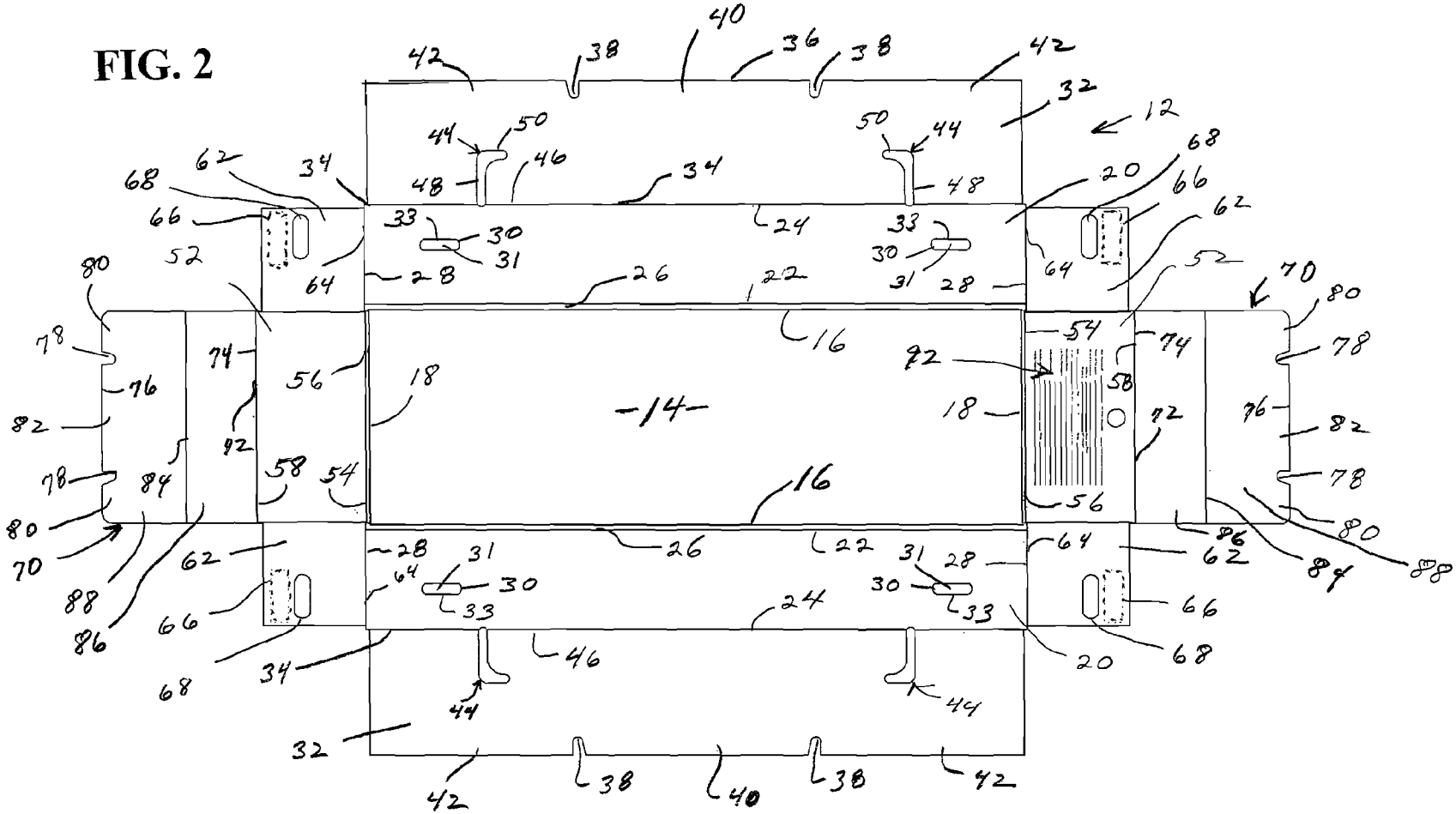
FIG. 2 is a bottom plan view of the blank for forming the casket of FIG. 1.
Figure 3:
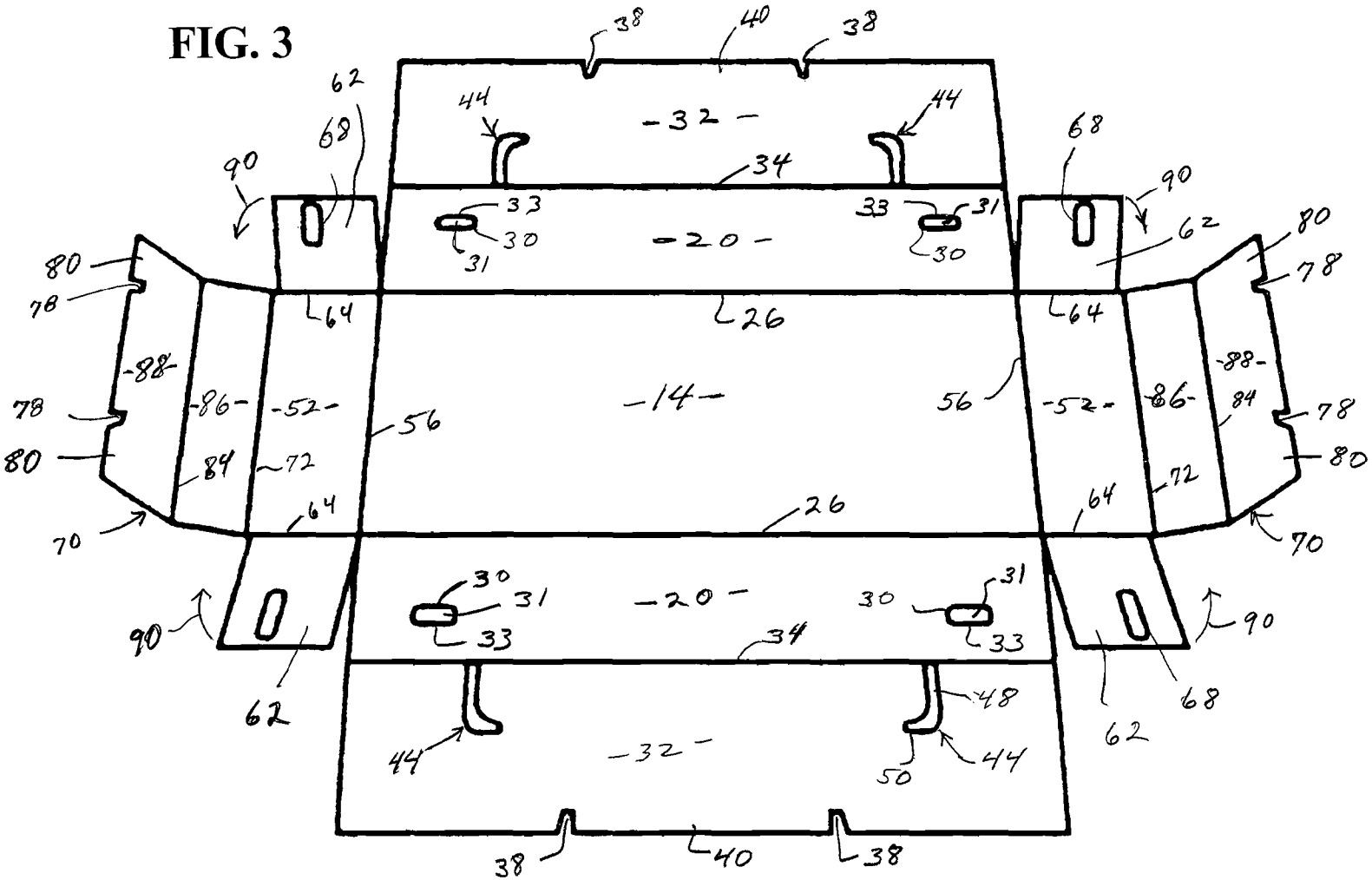
FIG. 3 is a top perspective view of the blank for forming the casket.

Casket 10 is formed from a blank 12 as shown in FIGS. 2 and 3. FIG. 2 is a bottom view of the blank, while FIG. 3 is a top view of the blank which when folded forms the inside of casket 10.

Blank 12 includes a bottom panel 14 having opposite side edges 16 and opposite end edges 18. As shown in FIG. 2, bottom panel 14 has a substantially rectangular configuration which defines the dimensions of casket 10. First and second side wall panels 20 have a first edge 22 and a second edge 24. Each first edge 22 of the side wall panels 20 are coupled to a respective side edge 16 of bottom panel 14 along a fold line 26. Side wall panels 20 have a longitudinal length substantially equal to the longitudinal length of bottom panel 14 and a width corresponding to the height of the casket 10. Adjacent the longitudinal ends 28 of side wall panels 20 are cut-outs or punch-outs 30 forming hand holds or handles for carrying casket 10. In the embodiment illustrated, each side wall panel is provided with two cut-outs 30 with one positioned at each longitudinal end of each side wall panel 20. Side wall panels 20 are folded to a position substantially perpendicular to bottom panel 14 as shown in FIG. 1 to define a side wall of the casket 10. The fold lines of blank 12 can be an embossed or pressed line or score lines. Preferably, the fold lines enable the blank to be easily folded without reducing the strength of the casket.

Figure 7:
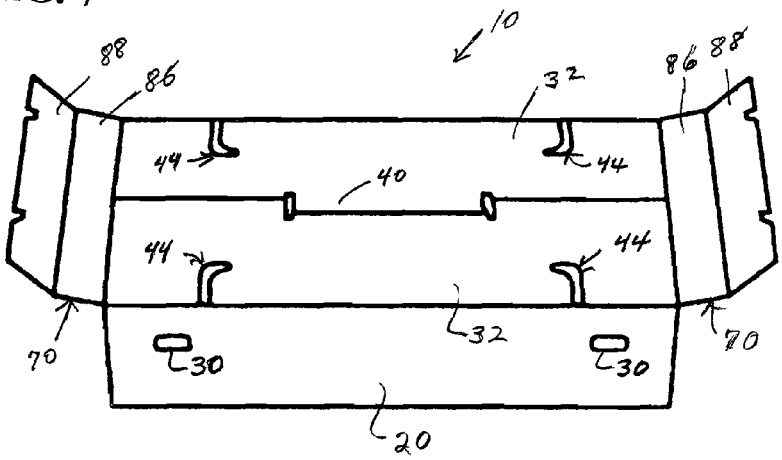
FIG. 7 is a perspective view of the casket of FIG. 6.
Figure 8:
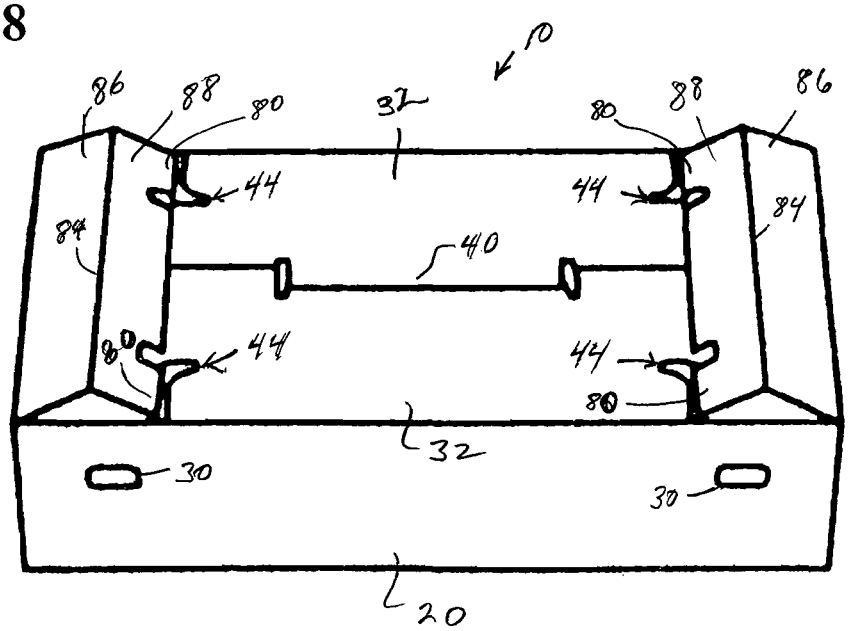
FIG. 8 is a perspective view showing the tabs of the top end panels being inserted into slots in the top side panels.

A top side panel 32 is coupled to the second end 24 of each side wall panel 20 by a fold line 34. Top side panels 32 have a longitudinal length corresponding substantially to the longitudinal length of side wall panels 20. Preferably, top side panels 32 have a width such that the top side panels can be folded inwardly as shown in FIG. 1 to at least partially overlap to form a closure for the casket 10. Top side panels 32 have a longitudinal outer edge 36 with two spaced apart notches 38. Notches 38 define a central coupling tab which forms an interlocking member for interlocking each of the top side panels together. As shown in FIG. 1, top side panels have a width to overlap a sufficient amount so that the central tab 40 of one of the top side panels 32 can slide under the central coupling tab 40 of the opposite top side panel with the corresponding notches 38 engaging each other. Notches 38 also form end portions 42 spaced outwardly from central tab 40 which can overlie each other in the closed position. As shown in FIGS. 1 and 7, end portions 42 overlie each other in the closed position and one of the central tabs 40 is inserted under the opposite central tab for retaining top side panels in the closed position.

As shown in FIGS. 1 and 3, top side panels include slots 44 adjacent the inner edge 46. Slots 44 in the embodiment shown have a first portion extending perpendicular to fold line 34 in an outward direction toward the outer edge 36. Slots 44 include a second portion 50 extending perpendicular to first portion 48 and extend in a direction generally toward the center of each top side panel. As shown, each top side panel 32 is provided with two slots 44 at opposite ends.

An end wall panel 52 has a first end 54 coupled to the longitudinal end edges 18 of bottom panel 14 by a fold line 56. Each end wall panel 52 has a width corresponding substantially to the width of bottom panel 14 and a length corresponding to the height of casket 10. In the embodiment illustrated, end wall panel 52 has a substantially rectangular configuration with a second edge 58 which defines a top end of casket 10 and opposite side edges 60.

Each side edge 60 of end wall panel 52 includes a side flap 62 coupled thereto by a fold line 64. Side flap 62 has a width extending the length of fold line 64 and corresponding to the length of end wall panel 52. Side flap 62 has a width corresponding substantially to the width of side wall panel 20 and a length to overlap with a portion of side wall panel 20 when folded to form the casket 10. As shown in FIG. 2, side flap 62 includes a portion having an adhesive 66. Adhesive 66 is positioned in a location for attaching side flap 62 to a respective side wall panel when the blank is folded to form casket 10. Adhesive 66 is preferably a pressure sensitive adhesive which can have a release sheet covering the adhesive until the casket is assembled.

Side flap 62 includes a cut-out 68 forming a hand hold for carrying casket 10. Cut-out 68 is positioned to align with cut-out 30 in side wall panel 20 when in the folded position to form casket 10. In one embodiment of the invention, cut out 68 is an oval, elongated shaped hole or opening having a dimension and orientation corresponding to the cut out 30 in the side wall panel 20 to form a lifting handle or hole at each end on the side walls of the casket. The cut out 30 in each side wall panel 20 can be a similar opening. In one preferred embodiment, cut out 30 is formed from a partial cut to provide an inner tab 31 that is connected to the side wall panel by a fold line 33. The tab 31 is folded inwardly to extend through the corresponding cut out 68 and folded upwardly to couple the side flap 62 and the side wall panel 20 together. The tab also forms a smooth surface around the edges of the cut outs to provide a more conformable edge for lifting the weight of the casket.

The second edge of end wall panel 52 includes a top end panel 70 coupled to end wall panel 52 by a fold line 72. Top end panel 70 has a first edge 74 coupled to fold line 72 and a second outer edge 76. Top end panel 70 has a width corresponding to the width of end wall panel 52 and a length to partially overlap with top side panels 32 in the folded condition. The second outer edge 76 of top end panel 78 in the embodiment shown includes two spaced apart notches 78 forming a coupling portion and defining tabs 80 in a center tab portion 82. Tabs 80 have a length and dimension to fit into slots 44 when blank 12 is folded to form casket 10.

In a preferred embodiment, top end panel 70 includes a fold line 84 extending between opposite sides and parallel to fold line 72. Fold line 84 of top end panel 70 defines a first panel 86 and a second panel 88. Fold line 84 allows top end panel 70 to flex slightly to enable insertion of tabs 80 into slots 44.

Blank 12 is preferably made from a corrugated cardboard material having a waterproof or water resistant coating. The corrugated material preferably has sufficient strength when folded to support the weight of a body and to allow ease of transport. Casket 10 formed from blank 12 is sufficiently strong to be stacked during transport of multiple caskets.

Figure 4:
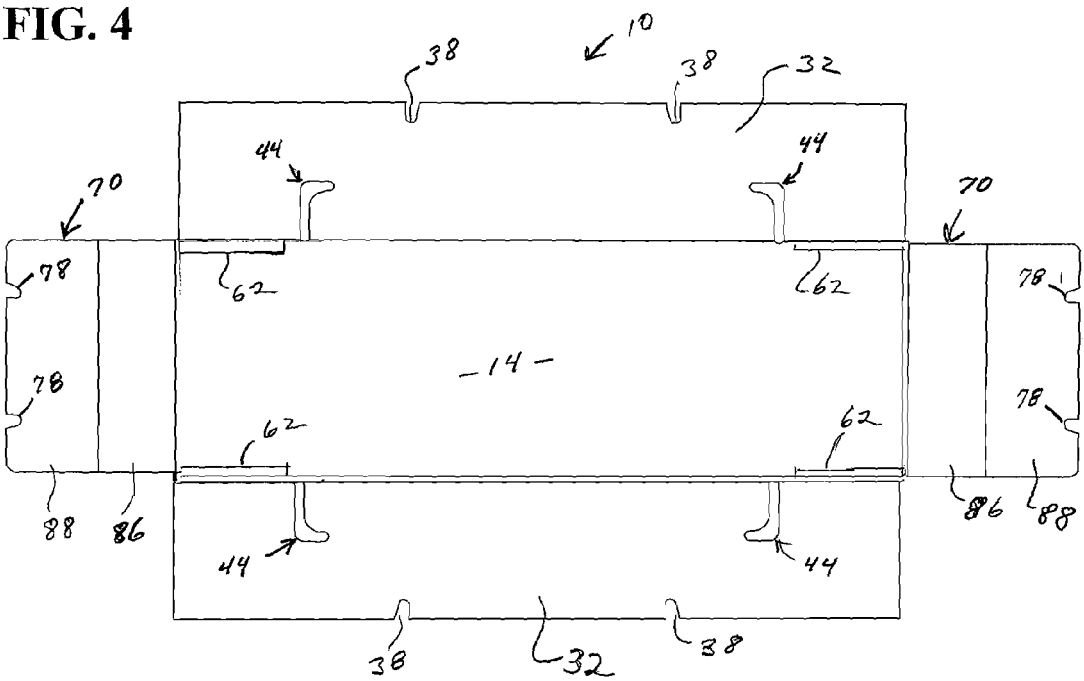
FIG. 4 is a top view of the casket showing the side walls and end walls assembled with the top side panels and end panels in the open position.
Figure 5:
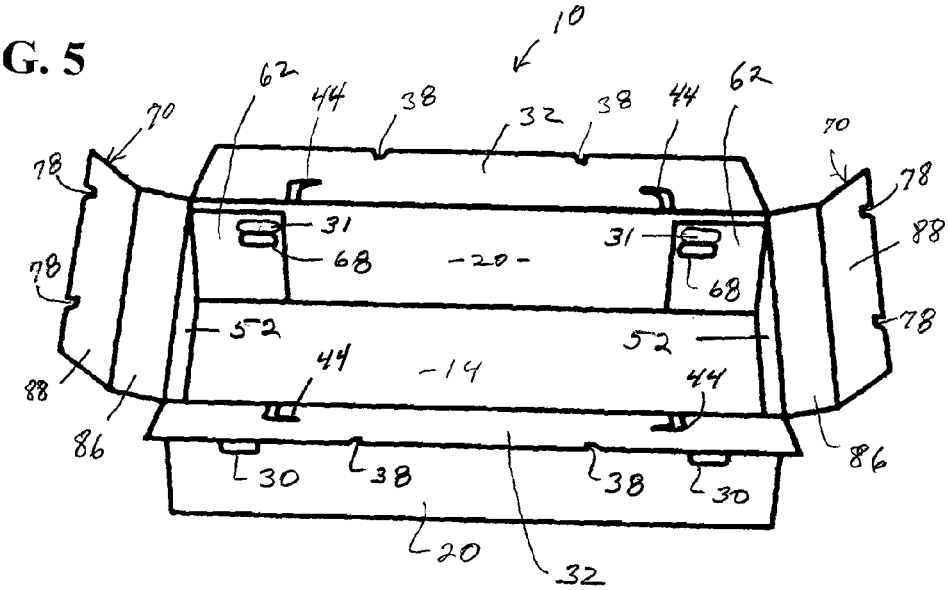
FIG. 5 is a perspective view of the partially assembled casket of FIG. 4.

Casket 10 is formed from blank 10 by folding the blank along the fold lines to the assembled and folded condition as shown in FIG. 1. Referring to FIG. 3, blank 12 is positioned with the top side facing upwardly. Side flaps 62 are folded upwardly in the direction indicated by arrows 90 shown in FIG. 3. End wall panels 52 are then folded perpendicular to bottom panel 14 and side wall panels 20 are folded upwardly perpendicular to bottom panel 14 along fold line 26. As shown in FIGS. 4 and 5, side flaps 62 are positioned on the inner surface of side wall panels 20 and attached to the inner surface of side wall panel 20 by the adhesive 66 on side flap 62. In the assembled position shown in FIGS. 4 and 5, cut-outs 68 of side flaps 62 are aligned with cut-outs 30 in each side wall panel 20.

Figure 6:
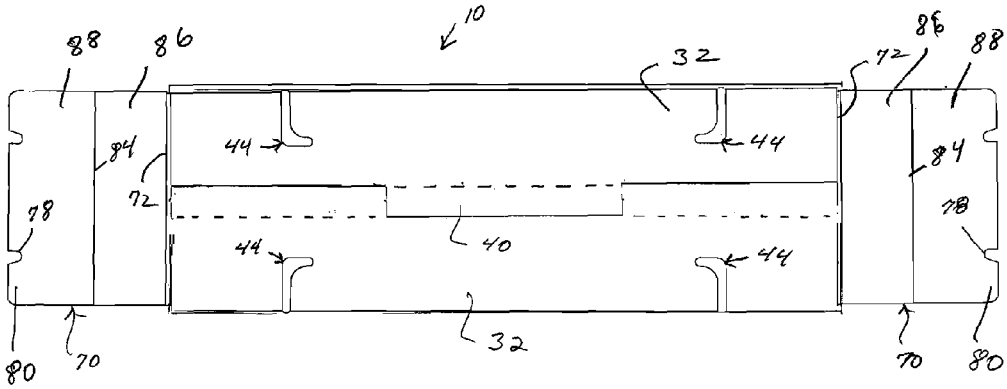
FIG. 6 is a top view of the casket showing the top panels folded inwardly and interlocking with each other.
Figure 9:
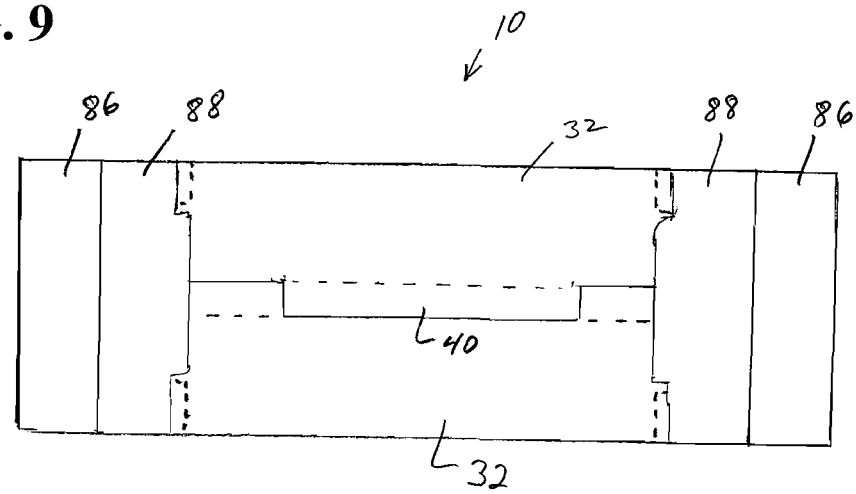
FIG. 9 is a top view of the assembled casket.

Casket 10 as shown in the configuration of FIGS. 4 and 5 is ready to receive a body. The body can be placed directly in casket 10 or the body can be enclosed within another or wrapped in a suitable liner material. Casket 10 is closed by folding top side panels 32 inwardly to the position shown in FIGS. 6 and 7 so that the notches 38 and central coupling tabs 40 interlock with each other so that the top side panels 32 form a top wall of casket 10. End wall panels 52 are then folded upwardly and bent slightly about fold line 84 so that interlocking tabs 80 can be inserted into the respective slot 44 in top side panels 32. Top end panel 70 is then pressed downwardly to interlock with top side panels 32 to secure casket 10 in the closed position as shown in FIGS. 1 and 9.

In one embodiment of the invention, casket 10 is provided with at least one side wall containing suitable indicia 92 such as the identification of the remains, and the point of delivery. In the embodiment shown, the indicia 92 are provided on one of the end wall panels 52.

While various embodiments have been chosen to illustrate the invention, it will be understood by those skilled in the art that various changes and modifications can be made to the invention without departing from the spirit and scope of the invention as defined in the appended claims.

What is claimed is:

1. A foldable casket blank for forming a disposable casket, said casket blank comprising:

a substantially rectangular bottom panel having first and second parallel sides and first and second parallel ends;

a first side wall panel coupled to said first side of said bottom panel by a fold line, said first side wall panel having a first top panel coupled thereto by a fold line;

a second side wall panel coupled to said second side of said bottom panel by a fold line, said second side wall panel having a second top panel coupled thereto by a fold line, said first top panel and said second top panel having a width to at least partially overlie each other in a folded position;

a first end wall panel coupled to said first end of said bottom panel by a fold line, said first end wall panel having a first top end panel coupled thereto by a fold line, said first top end panel having a coupling portion for coupling with said first and second top panels when in a folded position; and a second end wall panel coupled to said second end of said bottom panel by a fold line, said second end wall panel having a second top end panel coupled thereto by a fold line, said second top end panel having a coupling portion for coupling with said first and second top panels in the folded position.

2. The casket blank of claim 1, wherein said first and second top panels have an outer edge with a notch for interlocking said top panels together in the folded position.

3. The casket blank of claim 1, wherein said first and second top end panels have two spaced apart tabs defining said coupling portion; and said first and second top panels have a first end with a slot for receiving said tabs extending from said first top end panel for retaining said first top end panel in the folded position, and a second end with a slot for receiving said tabs extending from said second top end panel for retaining said first top end panel in the folded position.

4. The casket blank of claim 3, wherein each of said first and second top end panels have a first panel with a first end coupled to said respective end wall panel by a first fold line and a second panel coupled to said first panel by a second fold line, said second fold line enabling said top end panels to fold sufficiently to insert said tabs into a respective slot in said top panels.

5. A foldable casket blank for forming a disposable casket, said casket blank comprising:

a substantially rectangular bottom panel having first and second parallel sides and first and second parallel ends;

a first side wall panel coupled to said first side of said bottom panel by a fold line, said first side wall panel having a first top panel coupled thereto by a fold line;

a second side wall panel coupled to said second side of said bottom panel by a fold line, said second side wall panel having a second top panel coupled thereto by a fold line;

a first end wall panel coupled to said first end of said bottom panel by a fold line, said first end wall panel having a first top end panel coupled thereto by a fold line, said first end wall panel having a dimension to overlie said first and second top panels when in a folded position;

said first end wall panel having opposite side edges and a side flap coupled to each of said side edges by a fold line, each of said side flaps having a dimension to overlie a first end of a respective side wall panel in the folded position; and a second end wall panel coupled to said second end of said bottom panel by a fold line, said second end wall panel having a second top end panel coupled thereto by a fold line, said second top end panel having a dimension to overlie said first and second top panels in the folded position;

said second end wall panel having opposite side edges and a side flap coupled to each of said side edges by a fold line, each of said side flaps having a dimension to overlie a second end of a respective side wall panel in the folded position.

6. The casket blank of claim 5, wherein said first and second ends of said first side wall panel has a hand hold opening, and said first and second ends of said second side wall panel has a hand hold opening; and each of said side flaps have a hand hold opening which aligns with a respective hand hold opening in a respective side wall panel when folded.

7. The casket blank of claim 5, wherein said side flaps include an adhesive for adhering to a respective side wall panel in the folded position.

8. The casket blank of claim 5, wherein said first and second top end panels have a coupling member; and said first and second top panels have a first end with a coupling member for retaining said first top end panel in a folded position overlying said top panels, and a second end with a coupling member for retaining said second top end panel in a folded position overlying said top panels.

9. A disposable casket formed from a one piece folded blank made of cardboard or fiberboard, said casket comprising:

a bottom wall;

a first upstanding side wall and a second upstanding side wall;

a first upstanding end wall and a second upstanding end wall, each said end wall having two side flaps coupled to an end of a respective side wall;

a first top wall having a first edge coupled to said first side wall by a fold line and a second top wall having a first edge coupled to said second side wall by a fold line, said first and second top walls having a width to at least partially overlap with each other in a closed position; and a first top panel coupled to said first end wall and a second top panel coupled to said second end wall, said first top panel and second top panel overlying and coupled to said first and second top walls.

10. The disposable casket of claim 9, wherein said side flaps include an adhesive and where said side flaps are adhesively attached to an inner side of a respective side wall.

11. The disposable casket of claim 9, wherein said first and second top walls have a second edge opposite said first edge with a coupling member for coupling said top walls together in the closed position.

12. The disposable casket of claim 11, wherein said coupling member is defined by a pair of spaced apart notches in said second edge forming a tab, wherein said notches of said first top wall interlock with said notches of said second top wall.

13. The disposable casket of claim 11, wherein said first top wall and said second top wall have a first end with a first slot and a second end with a second slot; and said first top panel has two spaced apart tabs for inserting in said first slots and said second top panel has two spaced apart tabs for inserting in said second slots of said second top panel.

14. The disposable casket of claim 13, wherein said tabs in said first and second top panels include two spaced apart notches to define said tabs.

15. The disposable casket of claim 13, wherein said first and second top panels include a first panel with a first edge coupled to a top edge of said respective end wall by a fold line and a second edge opposite said first edge, and a second panel having a first edge coupled to said second edge of said first panel by a fold line.

16. A disposable casket formed from a one piece, unitary cardboard or fiberboard blank, said casket comprising:

a planar bottom wall having a substantially rectangular configuration with a first side edge, a second side edge, a first end and second end;

a first side wall having a bottom edge coupled to said first side edge of said bottom wall by a fold line and extending substantially perpendicular to said bottom wall;

a second side wall having a bottom edge coupled to said second side edge of said bottom wall by a fold line and extending substantially perpendicular to said bottom wall;

a first end wall having a bottom edge coupled to said first end of said bottom wall by a fold line and extending perpendicular to said bottom wall, said first end wall having a first side edge with a first side flap coupled thereto by a fold line and superimposed on said first side wall and a second side edge with a second side flap coupled thereto by a fold line and superimposed on said second side wall;

a second end wall having a bottom edge coupled to said second end of said bottom wall by a fold line and extending perpendicular to said bottom wall, said second end wall having a first side edge with a first side flap coupled thereto by a fold line and being superimposed on said first side wall, and a second side edge with a second side flap coupled thereby by a fold line and being superimposed on said second side wall;

a first top panel coupled to a top edge of said first side wall and folded inwardly with respect to said casket; and a second top panel coupled to a top edge of said second side wall and folded inwardly with respect to said casket, said first and second top panels having a width to overlap each other to close said casket to define a top wall and where said first and second top panels include interlocking members to interlock with one another in the closed position.

17. The disposable casket of claim 16, further comprising:

a first top end panel having a first edge coupled to a top edge of said first end wall by a fold line and being foldable over said first top panel and second top panel and for coupling thereto; and a second top end panel having a first edge coupled to a top edge of said second end wall by a fold line and being foldable over said first top panel and said second top panel and being coupled thereto.

18. The disposable casket of claim 17, wherein said first top end panel has a second edge with two spaced apart first tabs;

said second top end panel has a second edge with two spaced apart second tabs; and said first and second top panels each have a first end with a first slot and a second end with a second slot for receiving said first and second tabs, respectively.

19. The disposable casket of claim 18, wherein said first top end panel has a fold line positioned between said first edge and second edge to enable insertion of said first tabs into said first slots, and said second top end panel has a fold line positioned between said first edge and second edge to enable said second tabs to be inserted into said second slots.

20. The disposable casket of claim 19, wherein said first top panel and said second top panel include two spaced apart notches to form a center tab defining said interlocking members.

* * * * *